US008570177B2

(12) United States Patent
Drucker

(10) Patent No.: US 8,570,177 B2
(45) Date of Patent: Oct. 29, 2013

(54) PROVIDING SENSORY FEEDBACK INDICATING AN OPERATING MODE OF AN INTERPRETIVE BIOS MACHINE

(75) Inventor: Steven J. Drucker, Atlanta, GA (US)

(73) Assignee: Microwave Science JV, LLC, Hackensack, NJ (US)

( * ) Notice: Subject to any disclaimer, the term of this patent is extended or adjusted under 35 U.S.C. 154(b) by 225 days.

(21) Appl. No.: 13/227,143

(22) Filed: Sep. 7, 2011

(65) Prior Publication Data

US 2012/0056748 A1 Mar. 8, 2012

Related U.S. Application Data

(60) Provisional application No. 61/380,537, filed on Sep. 7, 2010.

(51) Int. Cl.
*G08B 17/00* (2006.01)

(52) U.S. Cl.
USPC ..... 340/584

(58) Field of Classification Search
USPC ..... 340/584, 640, 643, 655, 815.4; 219/200
See application file for complete search history.

(56) References Cited

U.S. PATENT DOCUMENTS

| | | | | |
|---|---|---|---|---|
| 4,323,773 | A | 4/1982 | Carpenter | |
| 4,345,145 | A * | 8/1982 | Norwood | 219/492 |
| 4,390,766 | A * | 6/1983 | Horinouchi | 219/718 |
| 5,426,280 | A * | 6/1995 | Smith | 219/506 |
| 5,812,393 | A * | 9/1998 | Drucker | 700/15 |
| 5,883,801 | A * | 3/1999 | Drucker et al. | 700/15 |
| 6,249,710 | B1 * | 6/2001 | Drucker et al. | 700/15 |
| 6,681,137 | B1 * | 1/2004 | Drucker et al. | 700/15 |
| 6,809,301 | B1 | 10/2004 | McIntyre et al. | |
| 7,012,220 | B2 | 3/2006 | Boyer et al. | |
| 7,294,813 | B2 | 11/2007 | Ryu et al. | |
| 7,525,074 | B2 | 4/2009 | Bostick et al. | |
| 2008/0125911 | A1 | 5/2008 | Ebrom et al. | |
| 2010/0087932 | A1 | 4/2010 | McCoy et al. | |

OTHER PUBLICATIONS

Whirlpool Corporation, "Microwave Hood Combination Use & Care Guide" Estate by Whirlpool Corporation, Model TMH16XS, printed Apr. 2006.

International Search Report and Written Opinion in PCT/US11/50821 dated Jan. 25, 2012.

* cited by examiner

*Primary Examiner* — Phung Nguyen
(74) *Attorney, Agent, or Firm* — Hope Baldauff, LLC

(57) ABSTRACT

Technologies are described herein for providing sensory feedback to users of microwave oven or other thermal process stream device indicating operation in an interpretive language architecture mode. An indication is received through a device data entry mechanism that the interpretive language architecture mode of the device is to be initiated. Sensory feedback is provided indicating that the device is operating in the interpretive language architecture mode and that input data comprising a predetermined code for interpretation by the interpretive language architecture is expected. The sensory feedback may comprise flashing or illumination of specific keys on a keypad of the device data entry mechanism and may continue through entry of the input data comprising the predetermined code until completion of the resulting thermal process in the device.

20 Claims, 4 Drawing Sheets

PROVIDING SENSORY FEEDBACK INDICATING AN OPERATING MODE OF AN INTERPRETIVE BIOS MACHINE

CROSS-REFERENCE TO RELATED APPLICATIONS

This application claims the benefit of U.S. Provisional Patent Application No. 61/380,537 filed on Sep. 7, 2010 and entitled "Safety Mechanism for Multiple-Mode Devices," which is expressly incorporated herein by this reference in its entirety.

BACKGROUND

Microwave ovens presently in use may employ various data entry mechanisms to input data into the thermal process stream or oven control mechanism. These data entry mechanisms may be electrical and mechanical keyboards, card readers, light pens, wands, radio frequency detectors, or the like. The data may be transmitted to a controller of the thermal process stream. The implementation of the data results in a specimen within the oven receiving energy to heat the specimen to some desired temperature.

A microwave oven may employ an interpretive language architecture for the seamless transfer of energy to the specimen through a physical, chemical, or thermodynamic process stream of the oven, such as that described in U.S. Pat. No. 6,198,975. The interpretive language architecture may receive an indicia, such as an externally derived and predetermined code, through the data entry mechanism. The indicia or code may be disposed on the surface of the specimen or food package to be heated, and entered or scanned by an end user through the data entry mechanism, for example. The interpretive system interprets the indicia or code and transforms it into user-independent commands. The user-independent commands enable the thermal process stream of the host microwave oven to function over a wide but controlled range of energy transfer to the specimen.

Such microwave ovens may be capable of operating in multiple operating modes, such as a traditional standard operating mode and an interpretive language architecture operating mode, as described above. A problem can arise, however, if a user effects data entry through the data entry mechanism thinking that one mode was enabled whereas, in reality, a different operating mode was enabled. For example, when the data entry mechanism is utilized to communicate a simple numeric code to the microwave oven for processing in the interpretive language architecture mode, failure to first identify the forthcoming data as intended to be directed to the interpretive system can result in the data being perceived by the thermal process stream or microwave oven as standard input, such as an operating time at full power. This can result in a thermal process operation far beyond that intended by the end user for the host or microwave oven, and may result in fire, physical property damage, end-user burns and injury, or death.

It is with respect to these considerations and others that the disclosure made herein is presented.

DETAILED DESCRIPTION

Technologies are described herein for providing sensory feedback to users of microwave oven or other thermal process stream device indicating operation in an interpretive language architecture mode. Utilizing the technologies described herein, a user of the host microwave oven may be prevented from inadvertently entering a predetermined code intended for the interpretive language architecture mode but received by a controller of the microwave oven as standard input, such as an operating time at full power. This may avert a thermal process operation from taking place that is far beyond that intended by the user for the host or microwave oven, avoiding any potential fire, physical property damage, end-user burns, and injury that may have resulted.

While the subject matter described herein is presented in the general context of program modules that execute in conjunction with the execution of an operating system of a host microwave oven, those skilled in the art will recognize that other implementations may be performed in combination with other types of program modules. Generally, program modules include objects, routines, programs, components, data structures, and other types of structures that perform particular tasks or implement particular abstract data types. It should be appreciated that the subject matter described herein may be implemented as a computer-controlled apparatus, a computer process, a system, or as an article of manufacture such as a computer-readable storage medium. Computer-readable storage media include volatile and non-volatile, removable and non-removable media implemented in any method or technology for the storage of information, such as computer-readable instructions, data structures, program modules, or other data, and does not include transitory signals. For example, computer-readable storage media include, but are not limited to, RAM, ROM, EPROM, EEPROM, flash memory or other solid state memory technology, CD-ROM, DVD, HD-DVD, BLU-RAY, or other optical storage, magnetic cassettes, magnetic tape, magnetic disk storage or other magnetic storage devices, or any other medium that can be used to store the desired data structures, program modules, or other data and that can be accessed by the operating system of the microwave oven or other computing device. Furthermore, the claimed subject matter is not limited to implementations that solve any or all disadvantages noted in any part of this disclosure.

In the following detailed description, references are made to the accompanying drawings that form a part hereof and that show, by way of illustration, specific embodiments or examples. In the accompanying drawings, like numerals represent like elements through the several figures.

Figure 1:
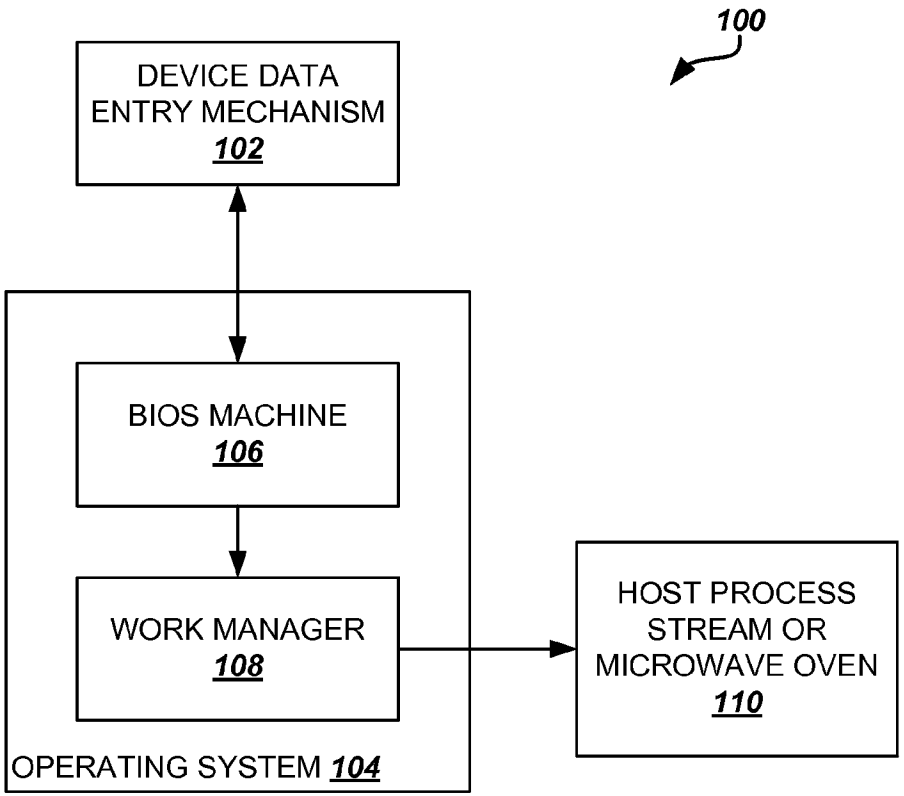
FIG. 1 is a block diagram showing aspects and components of an interpretive language architecture for a host microwave oven, according to embodiments described herein.

FIG. 1 shows a block diagram of an interpretive language architecture 100 for a seamless transfer of energy in a physical, chemical, or thermodynamic process stream, such as that described in U.S. Pat. No. 6,198,975 entitled "Interpretive Language Architecture for Controlling the Attributes of a Physical Chemical or Thermodynamic Process" (referred to herein as "Interpretive Language Architecture patent"), which is incorporated herein by this reference in its entirety. The interpretive language architecture 100 may be implemented in a host microwave oven or other thermal process stream device to control the energy transfer to a specimen or food product disposed in the confines of the oven or device. According to embodiments, the interpretive language architecture 100 comprises a device data entry mechanism 102, such as a keypad, electrical or mechanical keypad or keyboard, card reader, light pen, wand, radio frequency detector, or the like. The device data entry mechanism 102 may further provide visual, auditory, and other sensory feedback mechanisms for providing sensory feedback to the user of the host microwave oven or device.

The interpretive language architecture 100 also includes an operating system that may orchestrate the transfer of energy through the thermal process stream of the device to the specimen. The operating system 104 may further include a BIOS machine 106 and a work manager 108. The BIOS machine 106 may represent a class of objects or modules that command and control the operational features of the host microwave oven or other device as described in U.S. Pat. No. 5,812,393, which is incorporated herein by this reference in its entirety. The work manager 108 may represent a class of objects or modules that command and control work performed or to be performed on the specimen or food product by the thermal process stream, as disclosed by U.S. Pat. No. 5,883,801, which is incorporated herein by this reference in its entirety. The instructional output of the work manager 108 is transmitted to the host process stream or microwave oven 110 for implementation, i.e., to provide thermal response to the work instructions.

As further described in the Interpretive Language Architecture patent, the BIOS machine 106 may receive an indicia comprising an externally derived and predetermined code from the device data entry mechanism 102. The indicia or code may be disposed on the surface of the specimen or food package to be heated, and entered through a keypad comprising the device data entry mechanism 102, for example. The BIOS machine 106 and work manager 108 interpret the indicia or code and transform it into user-independent commands which are sent to the host process stream or microwave oven 110 to control the energy transfer to the specimen. The interpretive language architecture 100 is seamless and does not rely on preconceived data stored in the memory of the oven, device, or other computer to implement the work performed on the specimen through the described process.

Figure 2:
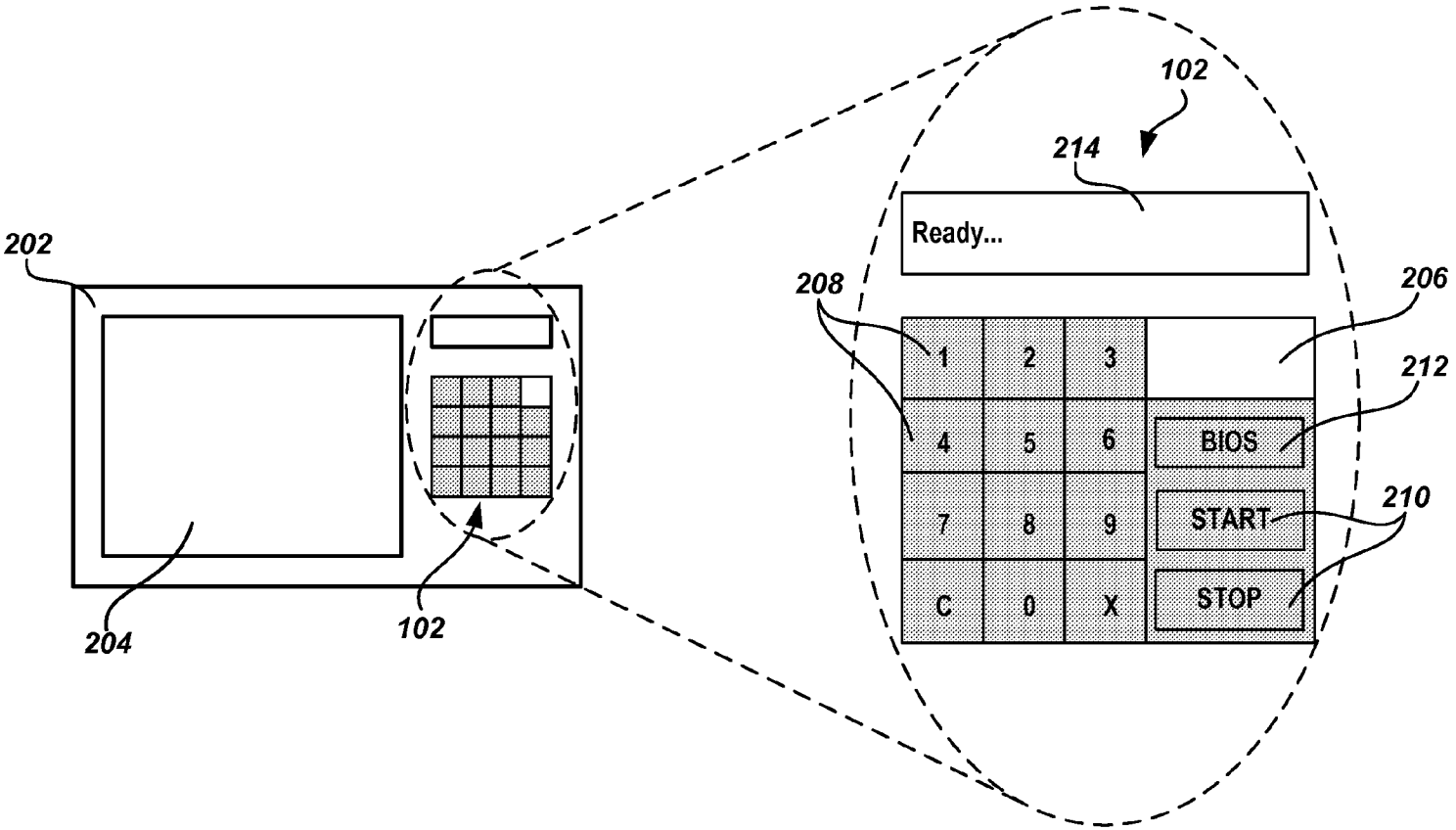
FIG. 2 is a schematic view of an illustrative host microwave oven data entry mechanism comprising a keypad and a visual display.

FIG. 2 shows an exemplary device data entry mechanism 102 implemented in a microwave oven 202. The microwave oven 202 may be any type of microwave oven that is found in households, restaurants, or industry to cook food and may be controlled by a microprocessor, computer, application specific integrated circuit ("ASIC"), or other computing device. According to embodiments, the microwave oven 202 incorporates the interpretive language architecture 100 described above. The microwave oven 202 further includes a chamber 204 or other enclosure in which the specimen to receive the energy from the thermal process stream is placed.

The device data entry mechanism 102 may include a keypad 206 comprising numeric keys 208, function keys 210, and other input keys, buttons, knobs, or controls that allow a user of the microwave oven 202 to input instructions for the heating of the specimen. The device data entry mechanism 102 may further include a display 214 for displaying status and other feedback data to the user throughout the process. It will be noted that the device data entry mechanism 102 illustrates the normal operational, darkened or un-illuminated state of a common microwave oven keypad during data entry and cooking, according to embodiments.

According to one embodiment, the process of heating the specimen through the interpretive language architecture 100 controlled thermal process stream, referred to herein as the "interpretive language architecture mode," begins with the user notifying the BIOS machine 106 that a forthcoming input data entered through the device data entry mechanism 102 is solely intended for use by the BIOS machine 106 and work manager 108. This may be accomplished by the user first pressing a special "BIOS" function key 212 appropriately labeled on the keypad. It will be appreciated that this may also be accomplished by any other method well known to practitioners of the art for the purposes of commencing a particular data entry mechanism or mode.

According to the current embodiment, the device data entry mechanism 102, e.g. the keypad 206 of the microwave oven 202, provides sensory feedback to the user indicating that the device is operating in the interpretive language architecture mode and that subsequent input data to be interpreted by the BIOS machine 106 and/or the work manager 108 is expected. The expected input data may comprise the predetermined code consisting of a number of numeric digits, for example. As shown at 300A in FIG. 3, the sensory feedback may comprise continuously flashing lights behind the "BIOS" function key 212, a "Start" function key or button, as well as the numeric keys 208 on the keypad 206, but not behind any of the other keypad keys. The described sensory feedback is intended to communicate to the user that (1) the microwave is in the interpretive language architecture mode and the BIOS machine 106 is awaiting completion of user-entered input data, and (2) such sensory feedback will continue until the data input is complete or the user has either pressed the "Start" function key or button to commence thermal process stream operation or the "Stop" or "Clear" keys or any such button or key to clear and end the interpretive language architecture mode.

Figure 3:
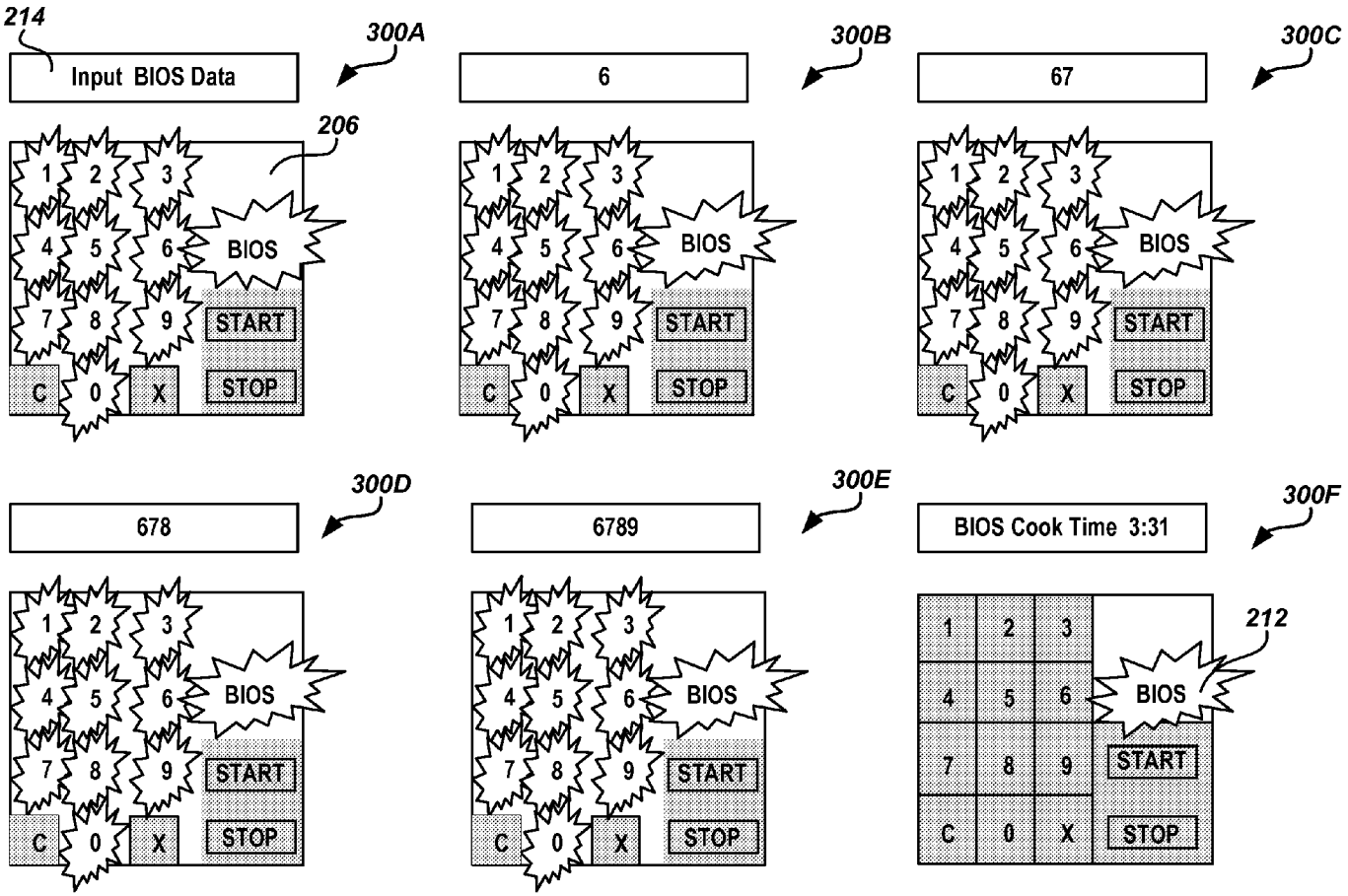
FIG. 3 shows an illustrative illumination of the keypad of the host microwave during a sequence data entry of a predetermined code intended for the interpretive language architecture of the host microwave oven, according to embodiments described herein.

FIG. 3 shows a sequence of visual states 300A-300F for the exemplary device data entry mechanism 102 after the "BIOS" function key 212 has been pressed and the microwave oven is in the interpretive language architecture mode awaiting the user-entered input data for the BIOS machine 106, such as the numeric code "6 7 8 9." As described above and shown at state 300A, the "BIOS" function key 212 and numeric keys 208 on the keypad 206 are illuminated or flashing indicating that the BIOS machine data stream is expected. In addition, the display 214 may further indicate that input data for the BIOS machine 106 is expected, as shown in the figure. Visual state 300B shows the device data entry mechanism 102 after the first key "6" in the numeric code has been entered through the keypad 206. The "BIOS" function key 212 and numeric keys 208 on the keypad 206 continue to be illuminated or flash. Similarly, visual states 300C-300E show the device data entry mechanism 102 as the input data is entered through the keypad 206 one digit at a time.

Visual state 300F shows the visual state of the device data entry mechanism 102 after (1) the "BIOS" function key 212 has been pressed, (2) the user-entered data input has been completed, (3) the "Start" function key or button has been pressed, (4) the user-entered data input has been interpreted by the BIOS machine 106 and/or work manager, and (5) the thermal process stream operation has commenced. For example, the keypad 206 may be returned to its normal darkened or un-illuminated state, and the total thermal process operating time interpreted from the user-entered input data by the BIOS machine 106 and/or work manager 108 may be shown in the display 214. According to one embodiment, the "BIOS" function key 212 remains illuminated or flashing until the thermal process initiated in the interpretive language architecture mode has ended.

Figure 4:
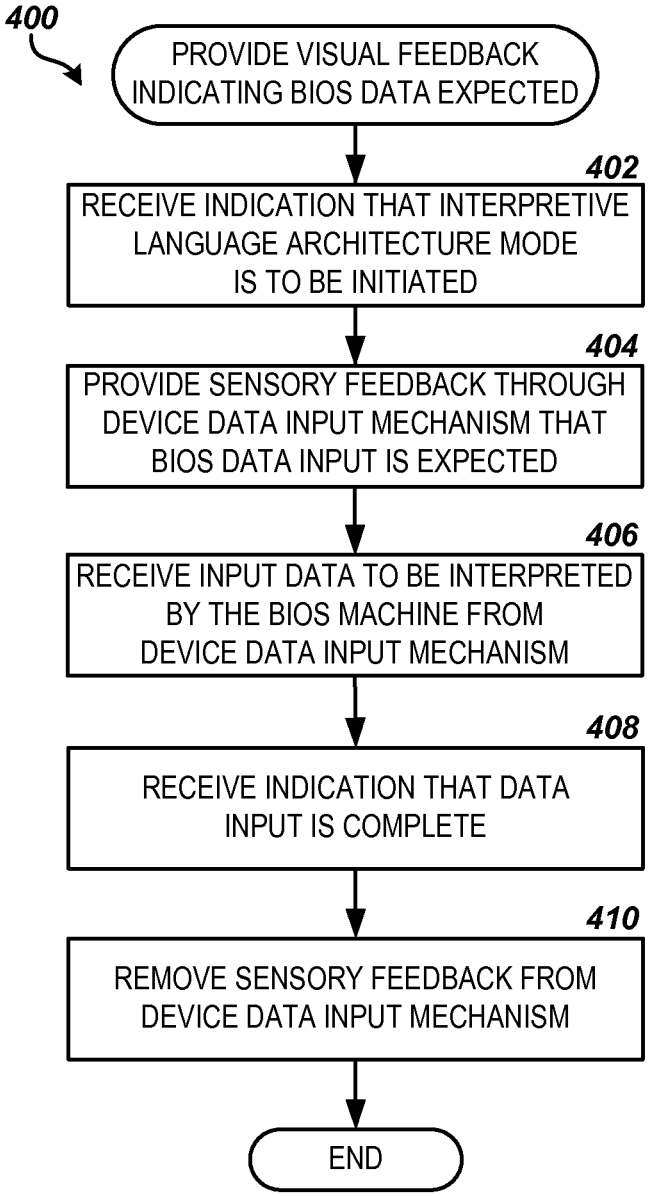
FIG. 4 shows a flow diagram of one method of providing sensory feedback indicating that the host microwave oven is operating in the interpretive language architecture mode and expects entry of the predetermined, according to embodiments described herein.

Referring now to FIG. 4, additional details will be provided regarding the embodiments presented herein. It should be appreciated that the logical operations described with respect to FIG. 4 are implemented (1) as a sequence of computer implemented acts or program modules running on a microprocessor, computer, ASIC, or other computing system in a microwave oven or other thermal process steam device and/or (2) as interconnected machine logic circuits or circuit modules within the oven or device. The implementation is a matter of choice dependent on the performance and other requirements of the microwave oven or device. Accordingly, the logical operations described herein are referred to variously as operations, structural devices, acts, or modules. These operations, structural devices, acts, and modules may be implemented in software, in firmware, in special purpose digital logic, and any combination thereof. It should also be appreciated that more or fewer operations may be performed than shown in the figures and described herein. The operations may also be performed in a different order than described.

FIG. 4 illustrates one routine 400 for providing sensory feedback indicating that the host microwave oven 202 is operating in the interpretive language architecture mode and expects entry of the predetermined code, according to embodiments described herein. The routine 400 may be performed by the BIOS machine 106 or other module of the operating system 104 of the microwave oven 202 or thermal process stream device, for example. It will be appreciated that the routine 400 may also be performed by other modules or components executing on other computing devices, or by any combination of modules, components, and computing devices.

The routine 400 begins at operation 402, where the BIOS machine 106 receives an indication that the process of heating the specimen through the interpretive language architecture mode is to be initiated. This may comprise a user of the microwave pressing the "BIOS" function key 212 on the keypad 206 of the device data entry mechanism 102, for example. It will be appreciated that this may also be accomplished by any other method known in the art for the purposes of commencing a particular data entry mechanism or mode.

The routine 400 proceeds from operation 402 to operation 404, where the BIOS machine 106 or other module of the operating system 104 provides sensory feedback to the user through the device data entry mechanism 102 that microwave oven 202 or device is operating in interpretive language architecture mode and that subsequent input data to be interpreted by the BIOS machine 106 and/or work manager 108 is expected. As further described above, the sensory feedback may comprise continuously flashing lights behind the "BIOS" function key 212, a "Start" function key or button, as well as the numeric keys 208 on the keypad 206, but not behind any of the other keypad keys, according to one embodiment. In addition, the display 214 may further indicate that input data for the BIOS machine 106 is expected, as shown at 300A in FIG. 3.

From operation 404, the routine 400 proceeds to operation 406, where the BIOS machine 106 receives the input data from the device data entry mechanism 102. For example, the BIOS machine 106 may receive the indicia comprising the predetermined numeric code associated with the specimen or food package to be heated. The routine 400 proceeds from operation 406 to operation 408, where the BIOS machine 106 receives an indication that the user-entered data input is complete. This may be indicated by the user pressing the "Start" function key or button on the keypad 206 of the device data entry mechanism 102, for example.

Upon receiving the indication that the data input is complete, the routine 400 proceeds from operation 408 to operation 410, where the BIOS machine 106 removes the previously provided sensory feedback to the user through the device data entry mechanism 102. For example, the keypad 206 of the device data entry mechanism 102 may be returned to its normal darkened or un-illuminated state. According to further embodiments, the BIOS machine 106 and/or the work manager 108 may interpret the user-entered data input and initiate the corresponding thermal process stream operation. The total thermal process operating time interpreted from the user-entered input data by the BIOS machine 106 and/or work manager 108 may further be shown in the display 214 of the device data entry mechanism 102. According to one embodiment, the "BIOS" function key 212 remains illuminated or flashing until the thermal process initiated in the interpretive language architecture mode has ended.

While some embodiments provided herein are specifically described in regard to a microwave oven used to heat a food package, those skilled in the art will readily appreciate that the embodiments provided herein may be utilized in any thermal process stream device that transfers energy to a specimen energy source along the electromagnetic radiation spectrum. For example, the embodiments may be used in thermal process stream devices that employ hot air, ultraviolet, laser light, infrared, alpha, beta, gamma, x-ray radiation, or combinations thereof. In addition, the specimens are not limited to food, but may also include, and not be limited to, painted articles where the paint is to be cured by infrared or UV light, coatings which may be cured by UV light, polymerization by UV light, irradiation of objects by radioactive energy beams, cutting, warming or melting of objects by infrared or laser light, and the like. In essence, wherever energy is to be directed at an article through a multi-step or multi-phase sequence (or a single step or phase) of operations is to occur in a specific operating mode of a device, the present embodiments may be employed to provide sensory feedback to users of the thermal process stream device indicating the current operating mode and that input data supporting the operating mode of the device is expected.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this application as defined in the following claims. Means-plus-function clauses are intended to cover the structures described herein as performing the recited function and not only structural equivalents but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

What is claimed is:

1. An interpretive language architecture controlled process stream device, the device comprising:

a device data entry mechanism for receiving an externally derived predetermined code;

a controller having a memory, the controller operatively disposed intermediate the device data entry mechanism and a means for controlling operational features of the device;

an operating system stored in the memory and operative to orchestrate a transfer of energy through a process stream of the device to a specimen; and an interpretive BIOS machine and a work manager integral the operating system and operative to cause the controller to receive the externally derived predetermined code from the device data entry mechanism, interpret the externally derived predetermined code, transform the code into user-independent functional commands for the device, and initiate the process stream using the user-independent functional commands, while providing sensory feedback to a user through the device data entry mechanism indicating that the device is operating in an interpretive language architecture with interpretive BIOS machine mode beginning from a reception of an indication that the interpretive language architecture with interpretive BIOS machine mode is to be initiated, through entry of input data comprising the externally derived predetermined code, and thereafter continuing through the process stream.

2. The device of claim 1, wherein the device data entry mechanism comprises a keypad.

3. The device of claim 2, wherein the indication that the interpretive language architecture with interpretive BIOS machine mode is to be initiated comprises an indication that the user has pressed a mode function key associated with the interpretive language architecture with interpretive BIOS machine mode on the keypad.

4. The device of claim 3, wherein providing the sensory feedback comprises illuminating lights disposed behind numeric keys and the mode function key associated with the interpretive language architecture with interpretive BIOS machine mode on the keypad, while leaving other of the keys on the keypad un-illuminated.

5. The device of claim 3, wherein the mode function key associated with the interpretive language architecture with interpretive BIOS machine mode on the keypad remains illuminated throughout the process stream.

6. The device of claim 1, wherein the process stream device comprises a microwave oven and wherein the specimen comprises a food package.

7. A method of providing sensory feedback to a user of a thermal process stream device of a current device operating mode for receiving data input, the method comprising:

receiving an indication that a device operating mode of the thermal process stream device is to be initiated;

providing sensory feedback to the user indicating that the thermal process stream device is operating in the device operating mode and that input data specific to the device operating mode is expected;

receiving user-entered input data for the device operating mode;

receiving an indication that the user-entered input data is complete; and upon receiving the indication that the user-entered input data is complete, removing the sensory feedback to the user.

8. The method of claim 7, wherein the indication that the device operating mode of the thermal process stream device is to be initiated, the user-entered input data for the device operating mode, and the indication that the user-entered input data is complete is received through a device data entry mechanism, and wherein the sensory feedback is provided to the user through the device data entry mechanism.

9. The method of claim 8, wherein the device data entry mechanism comprises a keypad.

10. The method of claim 9, wherein receiving an indication that the device operating mode of the thermal process stream device is to be initiated comprises receiving an indication that the user has pressed a mode function key on the keypad.

11. The method of claim 9, wherein providing the sensory feedback comprises continuously flashing lights disposed behind those keys on the keypad to be utilized by the user for entering the input data for the device operating mode and continuously flashing a light disposed behind a mode function key on the keypad associated with the device operating mode, while leaving other of the keys on the keypad un-illuminated.

12. The method of claim 7, wherein the device operating mode comprises an interpretive language architecture with interpretive BIOS mode, and wherein the user-entered input data comprises a code associated with a specimen intended to be interpreted by a BIOS machine and/or work manager controlled thermal process stream device to produce user-independent functional commands for controlling the thermal process stream device to perform work on the specimen.

13. The method of claim 12, wherein the thermal process stream device comprises a microwave oven and wherein the specimen comprises a food package.

14. A computer-readable storage medium comprising computer-executable instructions that, when executed by a controller of a process stream device, cause the process stream device to:

receive an indication that an interpretive language architecture with interpretive BIOS machine mode of the process stream device is to be initiated;

provide sensory feedback to a user of the process stream device indicating that the interpretive language architecture with interpretive BIOS machine mode is active and that input data comprising a predetermined code associated with a specimen upon which to perform work is expected, wherein the predetermined code is intended to be interpreted by a BIOS machine and/or work manager of the process stream device to produce user-independent functional commands for controlling the process stream device;

receive user-entered input data comprising the predetermined code;

receive an indication that the user-entered input data is complete; and initiate the user-independent functional commands in the process stream device to perform work on the specimen.

15. The computer-readable storage medium of claim 14, further comprising computer-executable instructions that cause the process stream device to remove the sensory feedback to the user.

16. The computer-readable storage medium of claim 14, wherein the indication that the interpretive language architecture with interpretive BIOS machine mode is to be initiated and the predetermined code are received through a keypad of a device data entry mechanism of the process stream device, and wherein the sensory feedback is provided to the user through the device data entry mechanism.

17. The computer-readable storage medium of claim 16, wherein receiving the indication that the interpretive language architecture with interpretive BIOS machine mode is to be initiated comprises receiving an indication that the user has pressed a mode function key associated with the interpretive language architecture with interpretive BIOS machine mode on the keypad.

18. The computer-readable storage medium of claim 16, wherein providing the sensory feedback comprises illuminating lights disposed behind numeric keys and a mode function key associated with the interpretive language architecture with interpretive BIOS machine mode on the keypad, while leaving other of the keys on the keypad un-illuminated.

19. The computer-readable storage medium of claim 18, wherein the mode function key associated with the interpretive language architecture with interpretive BIOS machine mode on the keypad remains illuminated throughout an operation of performing work on the specimen in the interpretive language architecture with interpretive BIOS machine mode of the process stream device.

20. The computer-readable storage medium of claim 14, wherein the process stream device comprises a microwave oven and wherein the specimen comprises a food package.

* * * * *